United States Patent [19]

Franck et al.

[11] Patent Number: 4,488,721

[45] Date of Patent: Dec. 18, 1984

[54] HOCKEY STICK BLADE WITH SYNTHETIC COATING AND EXPOSED WEAR RESISTANT BASE

[76] Inventors: Donald R. Franck, 15 Lennox Dr., Binghamton, N.Y. 13903; Warren G. Grady, Jr., Hilltop Rd., Endwell, N.Y. 13760

[21] Appl. No.: 380,533

[22] Filed: May 21, 1982

[51] Int. Cl.[3] ..... A63B 59/12

[52] U.S. Cl. ..... 273/67 A

[58] Field of Search ..... 273/67 A, 67 D, 67 DA, 273/67 DB, 67 DC, DIG. 1, 167 R, 167 A, 167 B, 167 C, 167 D, 167 E, 167 F, 167 G, 167 H, 167 J, 167 K, 82 R, 80 B, 1 B, 67 R; D21/210, 211

[56] References Cited

U.S. PATENT DOCUMENTS

| | | | |
|---|---|---|---|
| 2,797,923 | 7/1957 | Dettman | 273/82 R |
| 3,489,412 | 1/1970 | Franck et al. | 273/80 B |
| 3,638,942 | 2/1972 | Basset | 273/DIG. 1 |
| 4,059,269 | 11/1977 | Tiitola | 273/67 A |
| 4,172,594 | 9/1979 | Diederich | 273/67 A |
| 4,351,530 | 9/1982 | Bertozzi | 273/82 R |
| 4,358,113 | 11/1982 | McKinnon et al. | 273/67 A |

*Primary Examiner*—Richard C. Pinkham
*Assistant Examiner*—Matthew L. Schneider
*Attorney, Agent, or Firm*—John W. Young

[57] ABSTRACT

This invention relates to a hockey stick comprised of a shaft and blade which simulates the principal characteristics of a wooden hockey stick including a blade in which a wear resistant core is provided wherein the area subject to wear are exposed and areas subject to impact are covered with a resin or plastic, and further provided with apertures in non-impact areas to increase the striking area and simulate the weight and weight distribution characteristics of a wooden hockey stick. The core is comprised of two substantially vertical surfaces and a base portion. The base portion of the core extends horizontally beyond an imaginary extension of the substantially vertical surfaces.

10 Claims, 10 Drawing Figures

FIG. 3
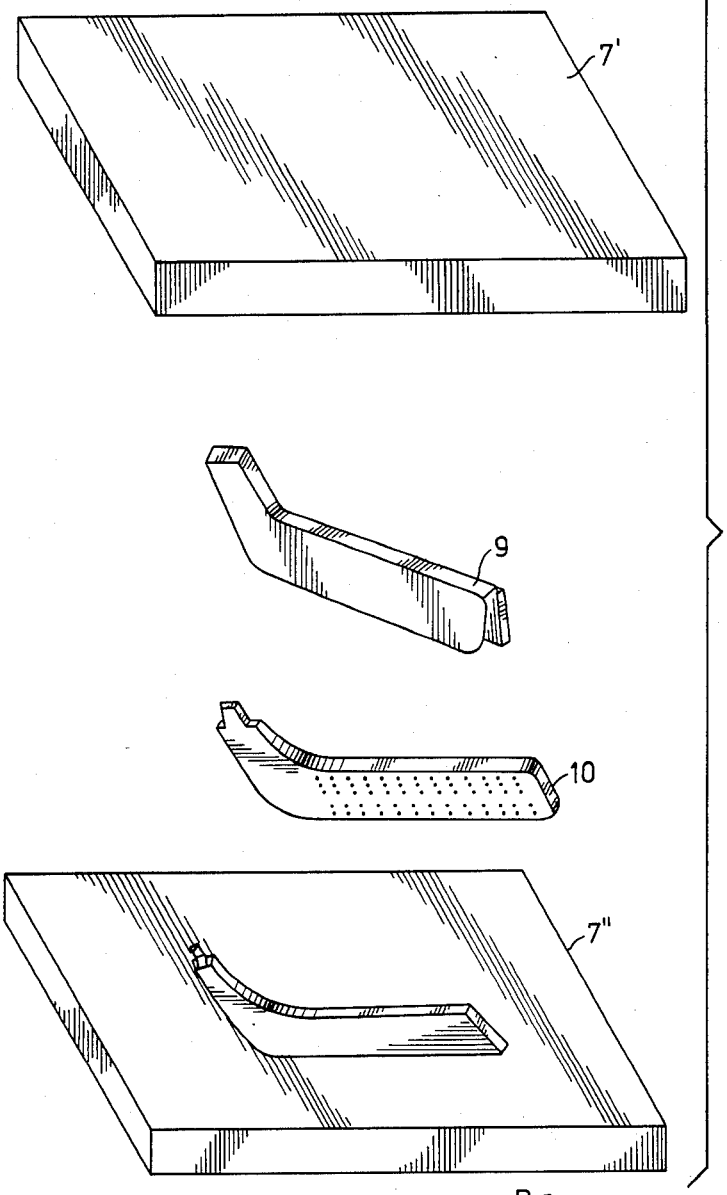
FIG. 1A
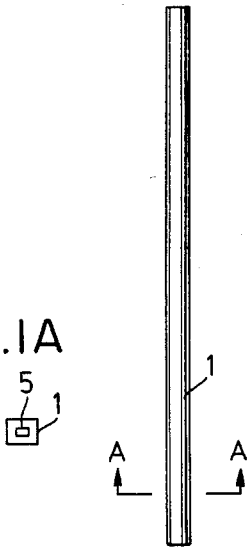
FIG. 1
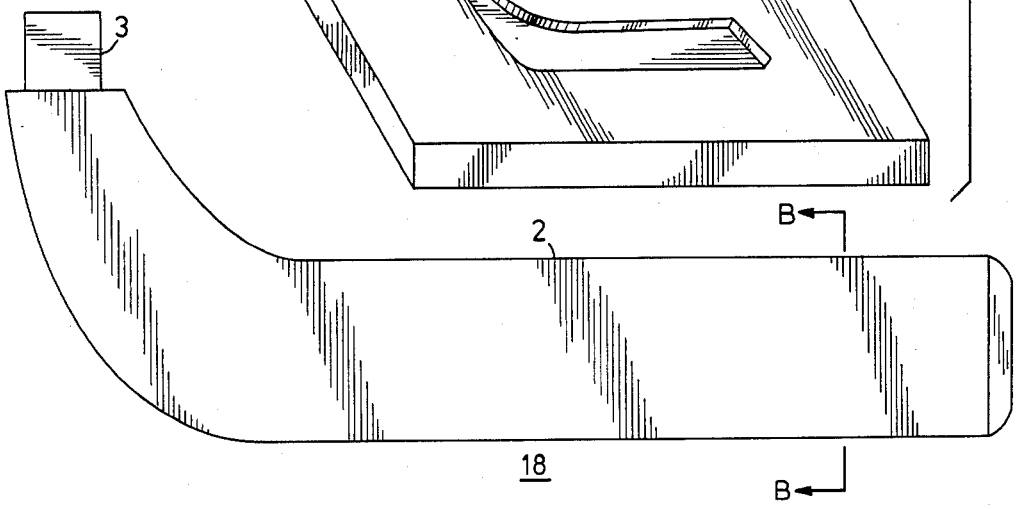
FIG. 2

HOCKEY STICK BLADE WITH SYNTHETIC COATING AND EXPOSED WEAR RESISTANT BASE

BACKGROUND OF INVENTION

The present invention relates to a method of manufacturing a hockey stick, and the blade thereof, and more particularly to a hockey stick and blade made out of synthetic materials or a combinations of wood and synthetic materials to provide a hockey stick possessing characteristics similar to or exactly like a totally wooden hockey stick.

Hockey sticks conventionally have been made and are constructed of wood, wood-fiberglass, wood-fiberglass and polycarbonate, or combinations, all of which are hereinafter referred to as "wooden hockey sticks". Usually handcrafted to specification, these sticks have been used by experienced players and the public as the norm for many years. Current "wooden hockey sticks" are inherently subjected, through use, to chipping, peeling, splintering, cracking, warping, delaminating, etc. Numerous and varied substitutes and combinations have been advanced in the past twenty years and some have improved lifetime but the substitutes do not possess the combination of weight, balance, blade size and stiffness qualities of a completely wooden stick and consequently are not totally acceptable. The experienced player insists on a stick with the characteristics of a good totally wooden hockey stick and is reluctant to accept a substitute without its equivalent "good" characteristics. The blade size, total weight, weight distribution or feel, and stiffness and strength of the whole stick, must be duplicated and simulated as though it were totally wood if the stick is to be accepted by the experienced player. Unfortunately, a totally wood stick as a very poor lifetime because it does not hold up well under the conditions in which it is used.

A conventional totally wooded hockey stick of proper characteristics has a gross weight of approximately 600 grams, or less, of which approximately 450 grams is in the handle portion, and 150 grams is in the blade portion, (the blade portion being considered that portion of the stick 5" vertically upward from the blade "heel" end of the stick). It is common today that in practice a wood-fiberglass blade or wood-fiberglass and polycarbonate or similar thermoplastic material blade or a totally synthetic blade has a physical size of about 10" along the base, which rests against the ice and 2½" in width. This is an area of approximately 25 sq" for the blade. The rules permit a blade size of no larger than a base of 12½" touching the ice and a width of less than 3". This is an area of approximately 37½ sq". As is easily seen, none of the current design wood-fiberglass or other synthetic combinations can meet the maximum size allowable by the rules without being too heavy. Consequently, the blade sizes have been reduced to keep the weight low and to keep the stick balanced. The smaller than allowable blade size significantly effects the functional performance of the stick since it makes it more difficult for the players to control the puck.

A further characteristic is the weight distribution and "feel" of the stick; this characteristic is extremely critical as players insist that it resemble the traditionally total wooden stick. Stiffness or, conversely, flexibility, is another characteristic that must be simulated with a closeness. A stick of suitable design suspended as a simple beam across two support points forty-five inches apart should not deflect more than one inch with a weight of forty-seven and one-half pounds suspended at its wide midpoint. This would be classified as a stiff stick. Additionally, a stick suspended as a simple beam upon two support points forty-four inches apart should support at least one hundred eighty pounds at the wide midpoint before breaking.

The U.S. Pat. No. 4,013,288 to L. J. Goverde, Mar. 22, 1977, is illustrative of an attempt to provide a substitute stick, the final result being inadequate, as the end product is not accepted by the experienced players as an acceptable substitute.

U.S. Pat. No. 4,059,269 issued Nov. 22, 1977, to A. J. Tittola, is a further example of such an approach for the blade portion of the stick. The acceptance is poor since the substituted material that is used has a higher specific gravity, and the blade must be either smaller, or heavier, or both, the alternatives being unacceptable.

The handle of a conventional stick is commonly made of ash for its longitudinal strength and stiffness and is approximately up to 58" long today, although in past years it was approximately 55". The blade is made from rock-elm or birch in the totally wooden sticks with possible overlays or underlays of fiberglass for their wear and impact qualities. Some hockey sticks use a solid core of wear-resistant material such as polycarbonate in the blade area with the surface overlays of re-enforcement, such as glass, and some of these also have overlays of wood on the surface.

It is the object of this invention to provide a hockey stick which will duplicate the balance, weight and stiffness characteristics of a good but totally wooden hockey stick but which additionally eliminate the deficiency of a totally wooden hockey stick or currently available wood-fiberglass or other combination sticks. In order to accomplish this there must be tradeoffs and innovations in design, materials and structure which are novel and unique and which permit the actual blade size to approach the allowable size permitted by the rules without the same blade being too heavy and thereby causing imbalance in the use of the total hockey stick.

To achieve the strength and feel characteristic of the handle and provide a more durable product, a hollow handle, such as shown in the patent to D. R. Franck et al, U.S. Pat. No. 3,489,412, can be provided which simulates and duplicates the properties of an ash handle.

The blade portion of the stick and particularly the core of the blade is preferrably constructed and manufactured by an injection molding technique similar to that shown in the patent to L. J. Goverde, U.S. Pat. No. 4,013,288, or it could also be cast without using injection molding. The base structure of the core of the blade is fabricated from a polycarbonate or other similar thermoplastic material and then covered on both striking surfaces with a material such as Scotchply® pre-preg (graphite or fiberglass) to duplicate the properties and characteristics of the elm or birch blade, and, further provide a more durable product. As it was stated hereinbefore, the duplication of weight, weight distribution and strength characteristics require a trade off which involves a consideration of the flexural strength, tensile strength, flexural modulus, resin content and specific gravities of the numerous materials necessary to construct the stick, which will be described hereinafter.

To achieve the proper effect and blade size and proper weight and weight distribution, the blade base or core is fabricated with apertures extending there through. Similar cores have been advanced by L. J. Goverde, U.S. Pat. No. 4,013,288, and A. J. Tittola, U.S. Pat. No. 4,059,269, however, neither approach has considered the necessity of parameter matching or combinations of materials to provide or simulate the characteristics of a wooden stick that has been improved. It has been found that a stronger blade possessing the proper impact qualities, weight, weight distribution and striking area, is produced by providing holes, located properly thereby preserving the maximum amount of the polycarbonate or other synthetic material in certain areas on the principal striking surfaces and to insure proper bonding. The principles will be more clearly understood by a reading of the detailed description set forth hereinafter. It is obvious that such an approach permits the retention of the proper area in the striking surface and still provides the other desired parameters.

The blade and handle assemblies can be separately constructed and joined. Thus, by constructing the entire stick in the manner a wooden stick is made, and by simulating and duplicating the characteristics and properties of the individual portions of the wooden stick, a hockey stick is created that will satisfy the lifetime and functional requirements of the player and the cost and price requirements of the manufacturer.

BRIEF DESCRIPTION OF THE DRAWINGS

For other objects and for a better understanding of the invention, reference may be had to the following detailed description taken in connection with the accompanying drawings, which show and illustrate the prefer red embodiments of the invention and which:

FIG. 1 A schematic view of the blade and handle portions of the hockey stick prior to being joined to form the complete stick.

FIG. 1A A cross-sectional view of the handle of the hockey taken along sectional lines A—A of FIG. 1 to more clearly show and describe the handle portion.

FIG. 2 is an enlarged view depicting the blade portion of the hockey stick after it has been manufactured.

FIG. 3 is a perspective view of the mold and the various elements used in the present method of manufacturing the blade of the hockey stick.

DESCRIPTION OF THE PREFERRED EMBODIMENTS

Figure 4:
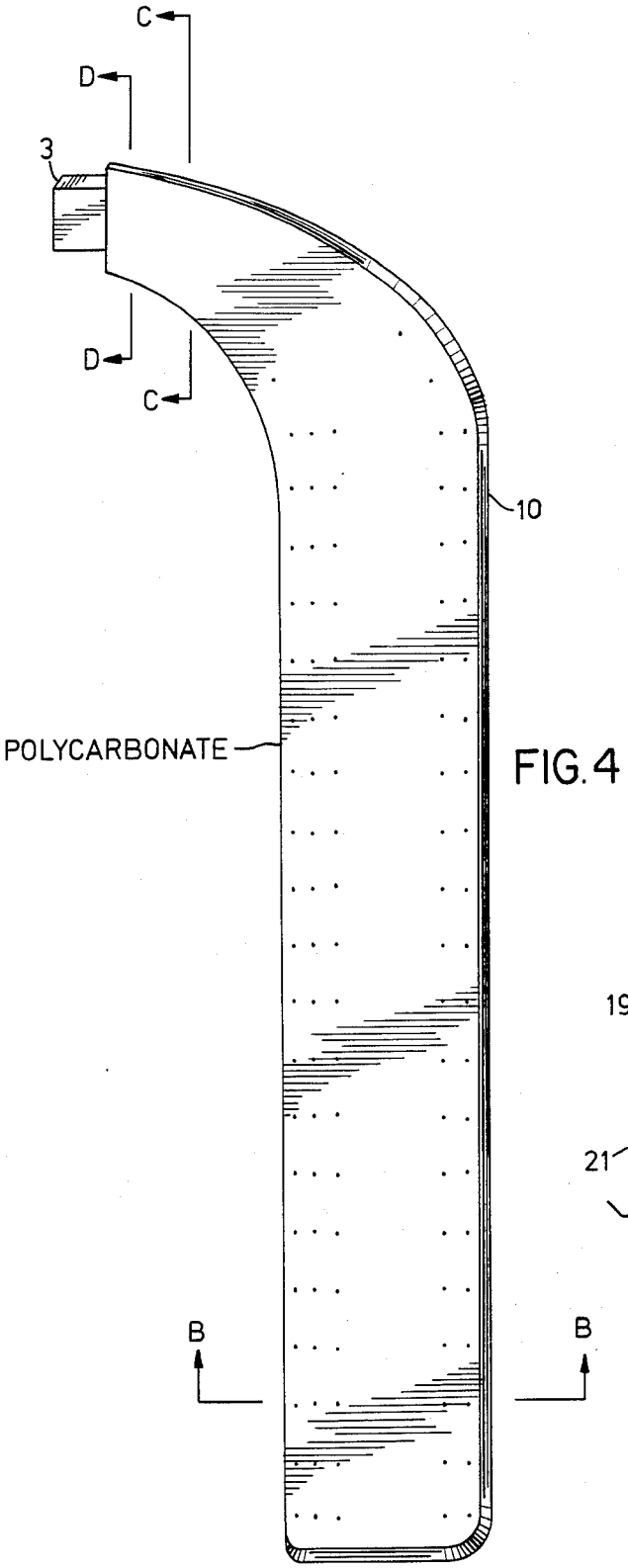
FIG. 4 is an enlarged frontal view of the preferred embodiment of insert or core of the blade used in the manufacture of the blade.

In the brief discussion provided in the background of the invention set forth hereinbefore it was mentioned that numerous attempts have been made to manufacture a non-wooden hocky stick, or portions thereof, which would meet the rigid and numerous objective and subjective parameters demanded by experienced hockey players; such attempts are shown in the U.S. patents to L. J. Goverde, U.S. Pat. No. 4,013,288 and to Tiitola, U.S. Pat. No. 4,059,269.

To duplicate and simulate the characteristics of a wooden stick and blade considerations must be specifically given to the specific gravity of the wood substitutes and the location and placement of the wood substitute. Additionally, the flexural strength, wear propensities, the tensile strength, the flexural modulus, and other parameters of all wood substitutes and their placement and location must be seriously considered so that quality of the wooden stick is duplicated and simulated. For instance, the core of the blade as shown in Tiitola has a specific gravity much higher than that of wood and consequently the weight of the blade is much heavier that that of the wooden blade, resulting in an unacceptable product for the experienced hockey player. The alternative, of course, is a smaller blade and that also is unacceptable, as it is not functionally adequate.

Long grain woods, such as used in hockey sticks, have a specific gravity of about 0.6 or 0.7, approximately 35 to 42 lbs per cubic feet and a modulus of elasticity of between one and two million. It has been found that various commercially available resins and plastics have specific gravities and flexural moduluses that are adaptable for use in the present invention, such as Scotch-ply® re-enforced plastics manufactured by Industrial Specialities Divisions/3M, and Ferropreg® epoxy kevlar, manufactured by the Ferro Corporation. A comparison of these distinct parameters clearly indicate that the substitution of one for the other can only be correctly accomplished with great thought and ingenuity.

| | Ash or Similar Wood | Kevlar | Graphite | Glass |
|---|---|---|---|---|
| Specific Gravity | .6-.7 | 1.35 | 1.57 | 1.85 |
| Flexural Modulus | $1\text{-}2 \times 10^6$ | $9 \times 10^6$ | $22 \times 10^6$ | $6 \times 10^6$ |

Thus, it is evident that when a substitute material is being considered for insertion into any specific portion of the stick, great care must be given to the placement and quantity of material used thereof. As it was stated in the background, the conventional hockey stick weighs approximately 600 grams with approximately 450 grams being contained in the shaft portion.

If an acceptable substitute is to be created, it is obvious that the same weight and weight distirbutions must be closely maintained or a product will be obtained that will not be acceptable to the experienced player.

The hockey stick is preferrably manufactured whereby the shaft and the handle are separately made, each in a separate molding operation and then joined. A single step method is cheaper and simpler, however, it creates parameters that are not acceptable.

Referring now to FIG. 1 and 1A, the hockey stick is comprised of two separate and distinct portions, handle 1 and blade 2.

Referring now to FIG. 1A, handle 1 is constructed with a hollow core so that the weight of the handle is maintained at or about 450 grams, and is simultaneously more durable and strong. A similar handle is shown in the patent to D. R. Franck et al, U.S. Pat. No. 3,489,412 and it is obvious that numerous methods may be employed to manufacture such a handle. The blade 2, see FIG. 2, is constructed separately with a cross sectional area of approximately thirty-seven and one-half (37½) square inches and a gross weight of approximately 150 grams and is adapted with a male insertion plug 3 for connection with shaft 1.

The core 10, see FIGS. 3 and 4, of blade 2 is constructed by the injection molding technique which is old and well-known in the art, and is described in detail by L. J. Goverde in U.S. Pat. No. 4,013,288. The manufacture, as distinguished from the structure, of core 10 is not deemed to be an integral portion of the present invention. The structure of core 10 will be described in detail hereinafter.

Referring now to FIG. 3, after core 10 has been fabricated, blade 2 is constructured by placing core 10 in a mold 7'', and a piece of pre preg material 9 is superimposed on core 10 extending vertically from the base of core 10 completely over the striking surface of blade 2 including the top most edge to the bottom on the back of the blade. It has been found that a single piece construction of the striking surface provides additional strength and reduces the chipping, splitting, peeling and cracking encountered by other methods. For example, the top of the blade normally is subject to impact from other sticks, pucks, etc., and the blade-end is subject to wear as is the base of the blade. The reinforcing envelope insures that the impact areas are covered with "impact" resistant materials and that the "wear" resistant materials are exposed in the wear areas. Additionally, it has been found that the single piece construction over the top most impact edge reduces chipping, delaminating and splintering and results in a more durable product. The pre-preg material is oriented to provide the optimization of the qualities stressed hereinbefore, and to simulate the characteristics of the wood used in the conventional blade. Mold top 7' is placed on mold base 7'', subjected to heat, approximately 300° F., and thereafter cured to form blade 2. The construction of core 10 will be discussed in detailed hereinafter, as its specific dimension comprises a portion of this invention.

After the handle portion and the blade portion have been separately manufactured, they are then joined and fused together, male insert 3 designed to snugly interdigitate with aperture 5 of shaft 1, see FIG. 1A.

The fusion process does not comprise a portion of the present invention and is not described in detail although there are several convention ways of joining the same in a permanent fashion such as glueing, adhesives, and the like.

A more complete understanding of the invention and the construction of Core 10 is secured and had from an understanding and description of FIGS. 4, 5, 6, 7, and 8.

Figure 5:
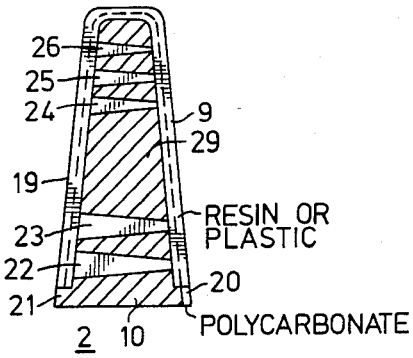
FIG. 5 is a cross-sectional view of the hockey stick taken along line B—B of FIG. 2 to more clearly understand the construction of the blade.

The completed blade 2 is shown in FIG. 5, which is a cross sectional view of FIG. 2 taken along line B—B of FIG. 2 to more specifically detail the internal construction of blade 2 and core 10.

Core 10 of the blade 2 extends essentially throughout the totality of the elevation of the blade 2 and for its complete horizontal width and is enclosed by pre-preg material 9 which extends from the base portion 17 of core 10 in a single wrap over both the entire striking surface 18 and the rear surface 19 of blade 2.

Base portion 17 of core 10 is fabricated so the striking edges 20 and 21 extend horizontally outwardly to present a planar striking surface and to be vertically coincident with pre-preg material 9, which comprises striking surfaces 18 and 19''. Striking edges 20 and 21 of core 10 are preferrably three-sixteenths of an inch in height and inasmuch as core 10 is constructed of a polycarbonate or a similar wear resistant material it is less subject to splintering, chipping, peeling, etc. Core 10 is further provided with five rows of truncated conical apertures 22, 23, 24, 25, and 26 which reduces the overall weight of blade 10, provide maximum strength in the area of the principal striking surface of the blade structure and the blade having a striking area of the desired dimensions. It is also obvious that if the entire core is fabricated of a material having a higher specific gravity than wood that the size of the blade would have to be reduced to retain the weight and weight distribution features.

Figure 8:
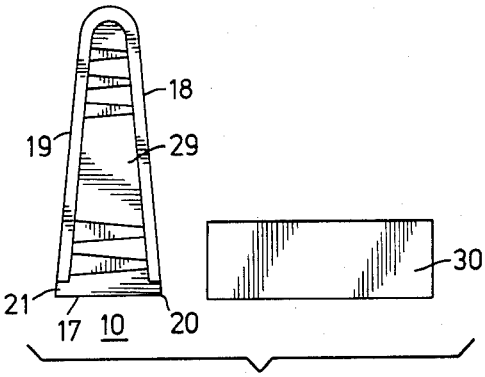
FIG. 8 is a cross-sectional view of the insert taken along line B—B of FIG. 4 and shown in relationship with a puck so to clearly illustrate the function and dimensional relationship of the insert.

The central portion 29 of core 10 is constructed with no apertures to maximize the strength of the blade in the area of maximum puck contact. Referring to FIG. 8, wherein a puck 30 is shown in physical relation with core 10 it has been found that structural failure occurs principally at edge 20 and in the central striking area 29. By fabricating core 10 with an increased strength characteristic in the failure areas 20, 21, and 29 a blade is produced that will be long wearing and not subject to the usual and typical failure. Typically, the striking area 29 of core 10 extends from an elevation of three quarters of an inch to an elevation of an inch and a quarter, which will span the standard puck which has a thickness of one inch, although it is obvious that changes or variations can be made without departing from the spirit of this invention. It is also obvious, if desired, that additional strengthing strips, devices, or materials could be added in the horizontal dimension of striking area 29 to further strengthen core 10 and provide a greater impact modulus without departing from the scope of the present invention.

Figure 7:
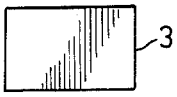
FIG. 7 is a cross sectional view of the top most portion of the blade of the hockey stick taken along section line D—D of FIG. 4 to more clearly show its construction.
Figure 6:
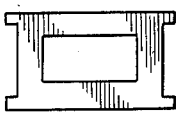
FIG. 6 is a cross-sectional view taken along line C—C of FIG. 4 showing the portion of the shaft and its construction.

The weight of blade 2 is further reduced by constructing the portion of blade 2, as shown in FIG. 6, taken along sectional lines C—C of FIG. 4, with the central portion 31 thereof being hollow. Again it has found that this portion of blade 2 when utilizing the materials described hereinbefore is not subject to the stress and consequent failure and that the various compromises can be accomodated in this portion of blade 2. However, it has been found that the terminal portion 3 of blade 2 which communicates with and is joined to handle 1 is subjected to severe stresses, as it is the area where the maximum flex and impact load is transmitted, which require additional strength, and accordingly is constructed with a solid core 3, as shown in FIG. 7.

Handle 1 and blade 2 are thereafter joined and a stick is secured that not only is not subject to the failure mode of the conventional stick but almost exactly duplicates and simulates the characteristics of the wooden stick.

Figure 9:
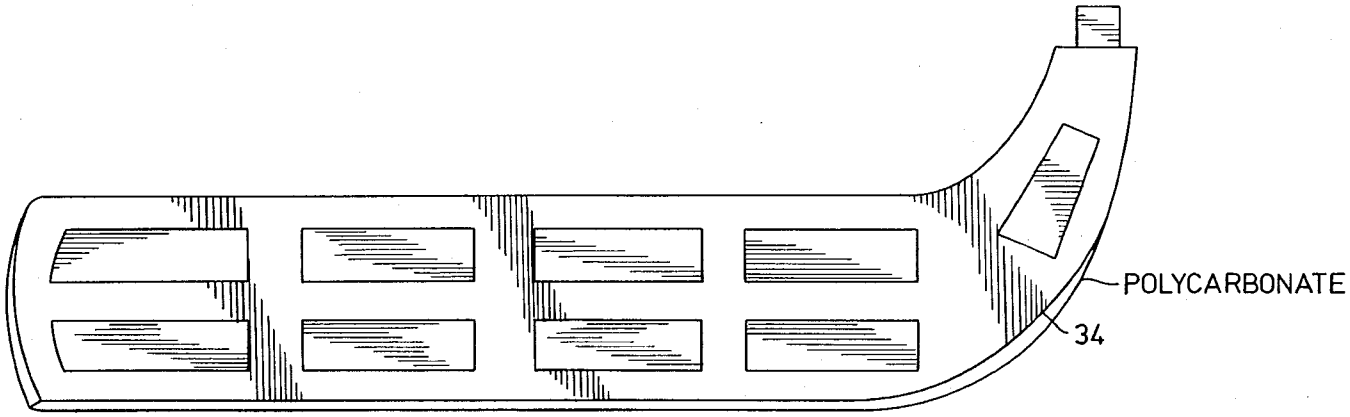
FIG. 9 is a further schematic view of an alternate form of the insert used in the manufacture of the blade.

Alternatively, a core structures 34, as shown in FIG. 9, may be substituted for the preferred embodiment shown and described herein. Core structure 34 is fabricated in relatively the same manner in which core 10 is manufactured to provide a wear resistant, resiliate material in the area of the blade which is principally subject to puck impact. It is obvious that other and further design of core 10 may implemented without without departing from the scope of the present invention.

Having thus described the invention we claim:

1. A hockey stick comprised of a hollow shaft and a blade wherein the shaft is constructed of a synthetic material having a specific gravity and strength to match and simulate the weight and weight distribution of a conventional shaft and blade wherein said blade is provided with a core of wear resistant material comprised of two substantially vertical surfaces and a base portion said base portion having bottom edge and side portions, said base portion extending horizontally beyond an imaginary extension of said substantially vertical surfaces, and a first synthetic material secured to said base portion but not covering said bottom edge and side portions, said synthetic material wholly enclosing said substantially vertical surfaces and the top most edge of said core whereby a hockey stick is provided that simulates the characteristics of a conventional hockey stick including the characteristics related to the size and weight of said blade.

2. A hockey stick as described in claim 1 wherein said core is provided with a plurality of apertures extending through said core whereby the weight of said blade and the striking area thereof are maintained at the desired and required parameters.

3. A hockey stick as set forth in claim 2 wherein said core is provided with an uninterrupted striking area on the striking surface in the area of maximum puck contact.

4. In a hockey stick or the like, a blade comprised of a core structure of wear resistant material having two substantially vertical surfaces, one of which is the primary striking surface, and a base portion; said base portion of said core extending horizontally beyond said substantially vertical surfaces; and, a first covering of a synthetic material secured to said base portion of said core and extending vertically upward from said base portion to cover said vertical surfaces and the entirety of the blade excepting the portion of said base of said core extending beyond said vertical surfaces to provide a blade of the proper size and weight and resistant to wear and impact.

5. A hockey stick as set forth in claim 4 where said core is provided with a plurality of rows of apertures extending from the first surface of said core through the second surface of said core, to provide a blade with the proper weight and an increased surface and striking area.

6. A hockey stick as set forth in claim 1 wherein said core is provided with a first portion area completely devoid of said apertures at a vertical elevation consistent with the region of the blade which is maximally in contact with the puck.

7. A hockey stick comprised of a shaft and blade, wherein said blade is provided with a core of wear resistant material comprising of two substantially vertical surfaces and a base portion, said base portion having bottom edge and side portions, said base portion extending horizontally beyond an imaginary extension of said substantially vertical surfaces, and a first synthetic material secured to said base portion but not covering said bottom edge and side portions, said synthetic material enclosing said substantially vertical surfaces and the top most edge of said core to provide a blade having the weight and size characteristics of a conventional wood blade.

8. A hockey stick as described in claim 7 wherein said core is provided with areas voided of material to provide a blade with an increase area.

9. A hockey stick as described in claim 8 wherein the wear resistant material is exposed on the end portion and base portion of said blade.

10. A hockey stick as described in claim 9 wherein the areas devoided of material are located in the area of minimal puck contact.

* * * * *